US005867097A

United States Patent [19]

Jung et al.

[11] Patent Number: 5,867,097

[45] Date of Patent: Feb. 2, 1999

[54] METHOD AND APPARATUS FOR ALARM SIGNAL PROCESSING

[75] Inventors: Chun-Sul Jung; Chang-Su Ko, both of Gumi, Rep. of Korea

[73] Assignee: SamSung Electronics Co., Ltd., Kyungki-do, Rep. of Korea

[21] Appl. No.: 699,645

[22] Filed: Aug. 19, 1996

[30] Foreign Application Priority Data

Aug. 18, 1995 [KR] Rep. of Korea ..... 25486/1995

[51] Int. Cl.[6] ..... G08B 1/00

[52] U.S. Cl. ..... 340/531; 340/506; 340/517; 340/525; 340/326

[58] Field of Search ..... 340/531, 506, 340/517, 525, 825.06, 505, 825.12, 825.16, 825.17, 326

[56] References Cited

U.S. PATENT DOCUMENTS

| | | | |
|---|---|---|---|
| 3,516,063 | 6/1970 | Arkin et al. | 340/505 |
| 3,969,709 | 7/1976 | Issacs et al. | 340/539 |
| 4,092,643 | 5/1978 | Stolarczyk | 340/539 |
| 4,160,246 | 7/1979 | Martin et al. | 340/539 |
| 4,331,953 | 5/1982 | Blevins et al. | 340/539 |
| 4,387,368 | 6/1983 | Day, III et al. | 340/539 |
| 4,524,354 | 6/1985 | Morgan | 340/525 |
| 4,994,787 | 2/1991 | Kratt et al. | 340/505 |
| 5,070,320 | 12/1991 | Ramono | 340/539 |
| 5,257,007 | 10/1993 | Steil et al. | 340/531 |
| 5,319,698 | 6/1994 | Glidewell et al. | 379/39 |
| 5,382,943 | 1/1995 | Tanaka | 340/539 |
| 5,422,626 | 6/1995 | Fish | 340/539 |
| 5,461,365 | 10/1995 | Schlager et al. | 340/573 |
| 5,500,639 | 3/1996 | Walley et al. | 340/539 |

*Primary Examiner*—Donnie L. Crosland
*Attorney, Agent, or Firm*—Robert E. Bushnell, Esq.

[57] ABSTRACT

A remote-controlled safety control system includes: an information transceiver for checking and controlling disorders for safety control, a controller for receiving alarm signals received from the information transceiver, generating alarm data after analyzing the alarm signals and then generating an alarm generation control signal, and an alarm unit, which is remotely located, for receiving the alarm generation control signal from the controller and for generating an alarm. An alarm signal processing method for maintaining a remote-controlled safety monitoring system includes the steps of: analyzing the alarm signals generated from information transceiver to generated alarm data; and checking periodically related X.25 processors and upon system disorders, generating alarm data and generating an alarm by transmitting the alarm data serially to a remotely located alarm unit.

10 Claims, 2 Drawing Sheets

METHOD AND APPARATUS FOR ALARM SIGNAL PROCESSING

CLAIM OF PRIORITY

This application make reference to, incorporates the same herein, and claims all benefits accruing under 35 U.S.C. §119 from an application entitled APPARATUS AND METHOD FOR ALARM SIGNAL PROCESSING earlier filed in the Korean Industrial Property Office on 18 Aug., 1995 and assigned Ser. No. 25486/1995.

BACKGROUND OF THE INVENTION

1. Field of the Invention

The present invention relates to a remote-controlled safety control system, and more particularly to a method and apparatus for informing an operator of the correct status upon the activation of an alarm.

2. Description of the Related Art

Generally a remote-controlled safety control system is used for crime prevention, disaster prevention, and gas leak detection, and for continuous sensing for changes in other unattended operations, and an operator is needed for the maintenance of the system. U.S. Pat. No. 4,092,643 entitled Security Device, U.S. Pat. No. 4,160,246 entitled Wireless Multi-Head Smoke Detector System, U.S. Pat. No. 4,994, 787 entitled Remote Intrusion Alarm Condition Advisory System, and U.S. Pat. No. 5, 422,626 entitled Electrical Monitoring System for example, each endeavor to construct wireless remote control alarm systems. Since these conventional remote-controlled control systems are usually equipped merely with a line-printer and a cathode ray tube for maintenance, an operator can not recognize the correct cause of an alarm activation and even may not realize that an alarm activation has occurred if the operator stays at locations, such as a night-duty room other than a control room.

SUMMARY OF THE INVENTION

Accordingly, it is an object of the present invention to provide an improved alarm signal processing method and apparatus.

It is another object to provided process and apparatus for informing an operator with an alarm signal through an external speaker for the maintenance of a remote-controlled safety control system.

It is still another object to provide a process and apparatus able to continually assure transmission of an alarm signal to a human operator, independently of the location of the operator relative to the apparatus. To achieve these and other objects, the invention provides a remote safety control system that analyzes alarm signals from subscriber lines to generate alarm data, analyzes alarm signals from safety monitoring lines to generate alarm data, checks related X.25 processors periodically to generate alarm data in case of the need of a service call, and generates an alarm by sending alarm data over a serial communication line.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
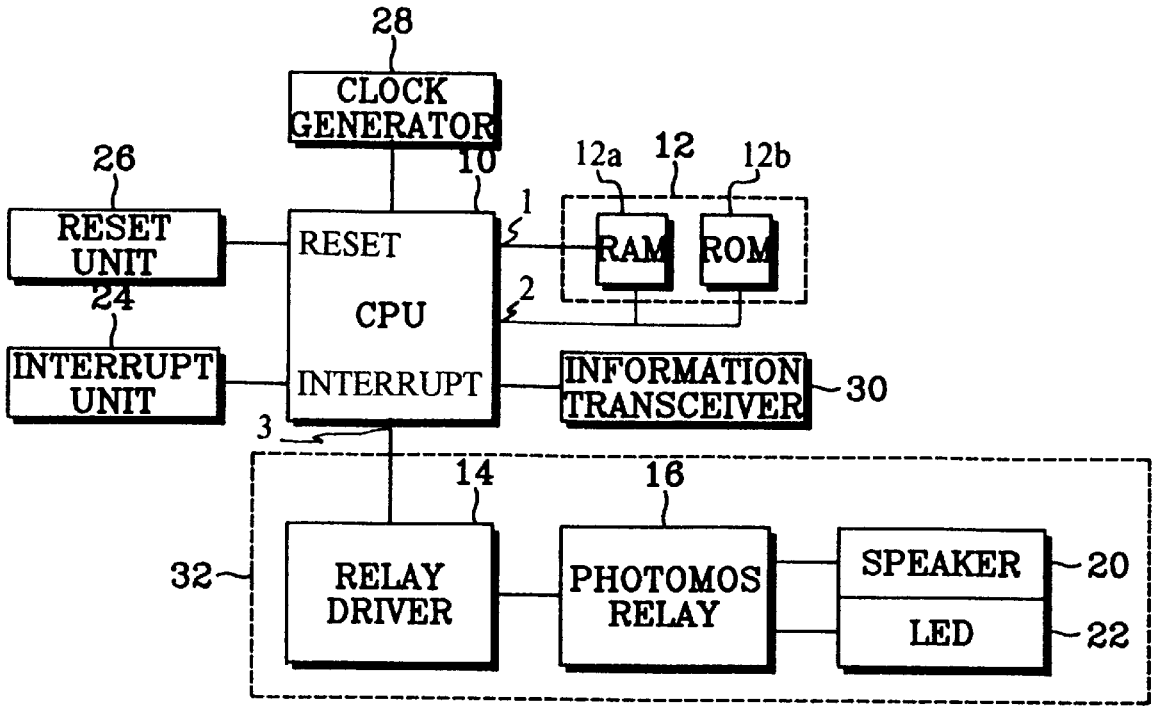
FIG. 1 is a block diagram of maintenance apparatus constructed in accordance with the principles of the present invention, which is used in conjunction with a remote-controlled monitoring system.

Turning now to the drawings, FIG. 1 is a block diagram of a maintenance apparatus constructed according to the principles of the present invention, used in conjunction with a remote-controlled monitoring system. A central processing unit, CPU 10 (e.g.—an 8-bit microprocessor such as part No. 80C31BH from the INTEL Corporation) has three I/O ports, an interrupt port, a reset port, a control port, and a transmission and reception port (T×D and R×D). An I/O port 1 is a data bus line connected to a random access memory RAM 12*a* and a read only memory ROM 12*b* of a memory unit 12. Data is exchanged through this data bus line 1. An I/O port 2 is an address line used for RAM and ROM from A0 to A13 by buffer control (not shown). An I/O port 3 is used for controlling relay driver 14 to display alarm status. A reset unit 26 is connected to the reset port of CPU 10. The reset unit 26 is divided into a power-on reset and a manual reset, and resets the CPU 10 when reset time $T_c$ is approximately 326.65 ms. An interrupt unit 24 connected to the interrupt port of CPU 10 is an alarm sound cut-off interrupt, uses chatter elimination elements to enable an operator to turn an alarm on and off. The relay driver 14 receives alarm control signals and an alarm-on display signal from CPU 10, and then turns on four photoMOS relays 16.

Figure 2:
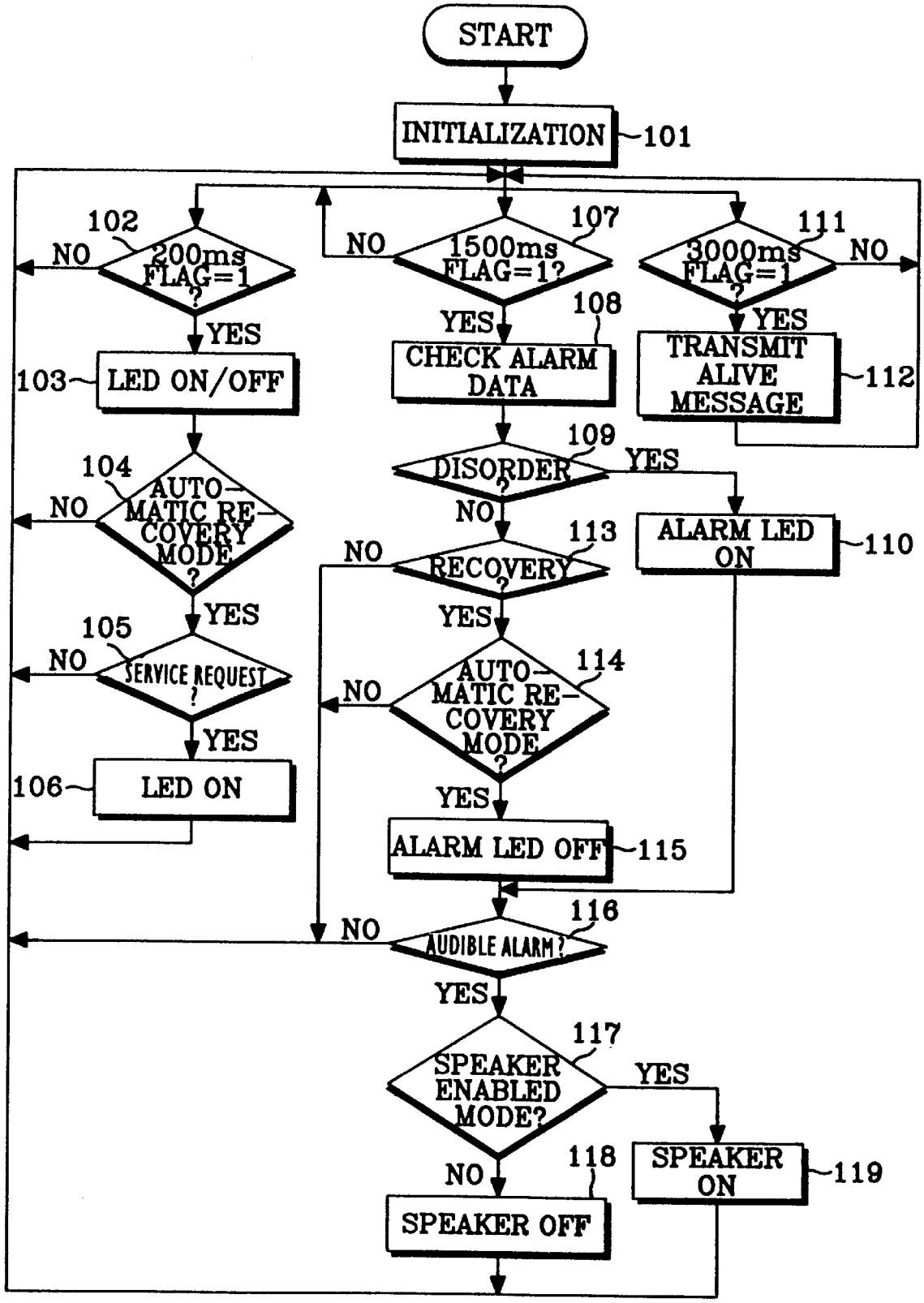
FIG. 2 is a flowchart illustrating an operation of processing an alarm signal according to the principles of the present invention.

FIG. 2 is a flowchart illustrating an operation of processing an alarm signal according to the practice of the present invention. In FIG. 2, alarm signals from subscriber lines are analyzed to generate alarm data, alarm signals from safety monitoring lines are analyzed to generate alarm data, related X.25 processors (not shown) are checked periodically to generate alarm data in case of a service call, and an alarm is activated by sending the alarm data over a serial communication line.

Figure 3:
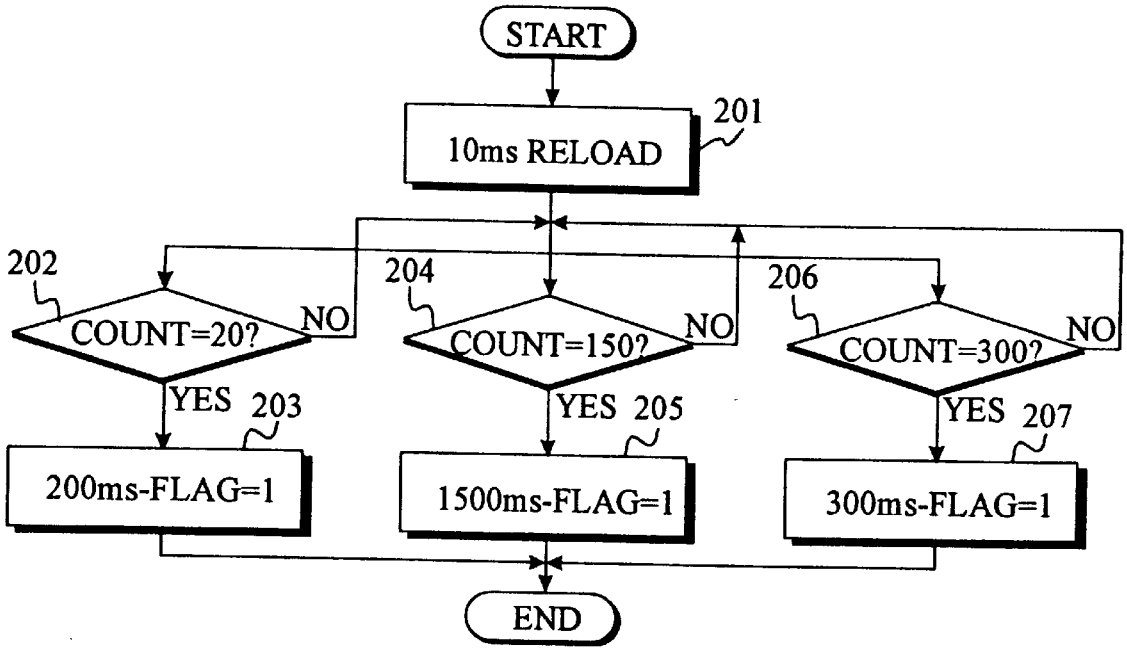
FIG. 3 is a flowchart illustrating a timer interrupt processing routine for the practice of the present invention.

FIG. 3 is a flowchart illustrating a process control operation of the timer interrupt routine according to the practice of the present invention. For a use in monitoring periods, a timer interrupt processing routine controls a counter and flags: the count in the counter is increased by one every ten millisecond interval; a 200 ms-flag is set to "1" whenever the counter counts to 20; a 1500 ms-flag is set to "1" each time the counter counts to 150.

The CPU 10 accepts received information from an information transceiver 30, or checks related X.25 processors at short intervals (about every twenty seconds) to directly collect alarm signals. The collected alarm signals are transmitted to the relay driver 14 through an RS232C standard port at 9600 bps using a predetermined protocol. The CPU 10 receives an alarm signal by an interrupt from the interrupt unit 24, and then stores the alarm signal in internal buffers. The alarm signal is analyzed for 100 ms in the next monitoring period. The stored alarm signal is analyzed if the 1500-milliseconds flag is "1" in the monitoring period. Upon the completion of the alarm signal analysis, the relay controller 14 controls the photoMOS relays 16 to control light emitting diodes 22: in case of the service request, the corresponding light emitting diode is turned on; the corresponding light emitting diode is turned off in case the automatic recovery mode is the selected mode; if the selected mode is the manual recovery mode, the corresponding light emitting diode is not turned off. However, the 200 ms-flag is set to "1" at an interrupt generated when the manual recovery mode is converted to the automatic recovery mode, so that the light emitting diode is turned off as the value stored in the internal buffers. Referring now to FIG. 2, once the system is turned on and the program is activated, the CPU 10 initializes the stored data and the state of input and output of the relay driver 14 in step 101, and activates the ten milliseconds timer. Then, CPU 10 increases the count in the counter every ten milliseconds in step 201 of FIG. 3, and if the counter reaches a count of 20, then proceeds to step 203 to set the 200 ms-flag to "1". When the counter reaches a count of 150 in step 204, CPU 10 proceeds to step 205 and set the 1500 ms-flag to "1". In addition, when the counter reaches a count of 300 in step 206, the 3000 ms-flag is set to "1". The CPU 10 checks the counter during monitoring periods to determine whether the 200 ms-flag is set to "l". The CPU 10 turns on the light emitting diodes to display the operating state the first time that the 200 ms-flag is set to "1", and activates the relay driver 14, the second time that the 200 ms-flag is set to "1", to turn off the light emitting diodes. In step 104, the CPU 10 determines whether the automatic recovery mode is the selected mode, and proceeds to step 105 if the automatic recovery mode is the selected mode. The CPU 10 checks for service requests in step 105, and if there is any service request, proceeds to step 106 to turn on light emitting diodes 22 in the alarm apparatus 32 in order to indicate the service request. The CPU 10 checks the 1500 ms-flag to determine whether it is "1" in step 107, and then proceeds to step 108 if the 1500 ms-flag is set to "1". In step 109, the CPU 10 checks alarm data for disorders and if there is no disorder, proceeds to step 113. In step 113, the CPU 10 determines whether there is any disorder recovery alarm, and proceeds to step 114 if there was any disorder recovery alarm. In step 114, the CPU 10 determines whether the system is in the automatic recovery mode, and proceeds to step 115 if the system is in automatic recovery mode. In step 115, the CPU 10 drives the alarm apparatus 32 to turn off light emitting diodes 22. If there is any disorder in step 109, then CPU 10 proceeds to step 110 and drives the alarm apparatus 32 to turn on light emitting diodes 22. The CPU 10 determines whether any alarms for audible alarm processing occurred in step 116, and then proceeds to step 117 if there are any alarms for audible alarm processing. In step 117, the CPU 10 determines whether the system is in a speaker enabled mode and if the system is in a speaker disabled mode, proceeds to step 118, and then turns off the speaker. If the speaker mode is the speaker enabled mode however, then the CPU 10 turns on the speaker to generate alarm sounds in step 119. In step 111, the 3000 ms-flag is checked for whether it is set to "1", and if it is set to "1", the program proceeds to step 112 for transmission of a program alive signal, and returns to the main flowchart after the transmission. The speaker and the display unit can be located in a night-duty room or an office, so that an operator can operate the system.

As discussed previously, in the present invention, upon the system disorder, the operator for the system maintenance is informed of alarm signals through the speaker and can maintain the safety monitoring system properly, even when staying in a night-duty room located far from the office where the host computer is installed.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. An alarm signal processing method for maintaining a remote-controlled safety monitoring system, said method comprising the steps of:

checking to determine if disorders have occurred by collecting information and analyzing collected information in accordance with predetermined timer interrupts;

determining whether the system is in an automatic recovery mode or a manual recovery mode, if a disorder has been determined to have occurred in said checking step;

turning off remotely located previously turned on light emitting diodes when it has been determined that the system is in said automatic recovery mode in said determining step;

generating an audible alarm, after said step of turning off said previously turned on light emitting diodes by driving a remotely located speaker when the system is in a speaker enabled mode.

2. A method as claimed in claim 1, further comprising the step of turning on said remotely located light emitting diodes when it has been determined that a disorder has occurred.

3. The method as claimed in claim 1, the step of turning off remotely located light emitting diodes and generating an audible alarm being effected by transmitting serial data over a serial data line.

4. The method as claimed in claim 2, the step of turning on said remotely located light emitting diodes being effected by transmitting serial data over a serial data transmission line.

5. An alarm signal processing apparatus for maintaining a remote-controlled safety monitoring system, comprising:

an information transmitting/receiving means for checking and controlling disorders for safety control;

a control means for receiving and analyzing alarm signals from said information transmitting/receiving means in accordance with predetermined timer interrupts, generating alarm data, and generating alarm generation control signals; and a remotely located alarm means including light emitting diodes and a speaker for receiving said alarm data and generation control signals from said control means and for generating an alarm in response thereto, said control means turning off said light emitting diodes upon it determining that the system is in an automatic recovery mode and generating an audible alarm with said speaker after turning off said light emitting diodes upon it determining that the system is in a speaker enabled mode.

6. An apparatus as claimed in claim 5, wherein said alarm means comprises:

a relay driving means for receiving said alarm generation control signals from said control means, and for generating a relay driving signal; and photoMOS relays, driven by said relay driving signal generated by said relay driving means, for generating an alarm signal for driving a speaker to produce an audible alarm and for generating a light emitting diode driving signal for illuminating said light emitting diodes.

7. An apparatus as claimed in claim 5, further comprising a serial data transmission line, connected between said control means and said alarm means, for transmitting said alarm generation control signals and said alarm data.

8. An apparatus as claimed in claim 6, further comprising a serial data transmission line, connected between said control means and said alarm means, for transmitting said alarm generation control signals and said alarm data.

9. An alarm signal processing apparatus for maintaining a remote controlled safety monitoring system, comprising:

information transmitting and receiving means for checking and controlling disorders for safety control;

a central processing unit, connected to said information transmitting and receiving means, for receiving and analyzing alarm signals and for generating alarm data and for generating an alarm generation control signal;

memory means, connected to the central processing unit, and including a read-only memory and a random access memory for storing programs and data received from the central processing unit and for transmitting said programs and data to said central processing unit;

a clock generator connected to said central processing unit for providing clock signals to said central processing unit;

reset means connected to said central processing unit, said reset means including manual reset means for enabling a user to manually reset said central processing unit and automatic reset means for automatically resetting said central processing unit upon the activation of the apparatus;

interrupt means connected to said central processing unit for enabling said user to provide interrupt signals to said central processing unit to disable the generation of alarms; and a remotely located alarm apparatus connected to said central processing unit and comprising a relay driver for receiving alarm generation control signals from said central processing unit and for providing outputs corresponding thereto and a plurality of photoMOS relays connected to receive said relay driver outputs, said photoMOS relays being respectively connected to a speaker and a plurality of light emitting diodes, said relay driver and photoMOS relays and said speaker and said light emitting diodes being connected such that said light emitting diodes are selectively illuminated and an audible alarm is produced by said speaker in accordance with said alarm generation control signal from said central processing unit.

10. The apparatus as claimed in claim 9, further comprising a serial data line, connected between said central processing unit and said alarm apparatus, for transmitting said alarm generation control signal from said central processing unit.

* * * * *